US009221474B2

(12) United States Patent
Klamka et al.

(10) Patent No.: US 9,221,474 B2
(45) Date of Patent: Dec. 29, 2015

(54) RETRACTABLE STEP ARRANGEMENT FOR A RAIL VEHICLE

(71) Applicant: Bombardier Transportation GmbH, Berlin (DE)

(72) Inventors: Heinz Klamka, Hennigsdorf (DE); Oliver Muller, Berlin (DE); Andreas Kelbel, Berlin (DE); Marcel Neumann, Berlin (DE)

(73) Assignee: Bombardier Transportation GmbH, Berlin (DE)

( * ) Notice: Subject to any disclaimer, the term of this patent is extended or adjusted under 35 U.S.C. 154(b) by 177 days.

(21) Appl. No.: 13/706,552

(22) Filed: Dec. 6, 2012

(65) Prior Publication Data

US 2013/0340647 A1 Dec. 26, 2013

(30) Foreign Application Priority Data

Dec. 8, 2011 (DE) ..... 10 2011 120 481

(51) Int. Cl.
*B61D 23/00* (2006.01)
*B61D 23/02* (2006.01)

(52) U.S. Cl.
CPC ..... *B61D 23/00* (2013.01); *B61D 23/025* (2013.01)

(58) Field of Classification Search
CPC ..... B61D 23/00; B61D 23/02; B61D 23/025
USPC ..... 105/436, 443–446, 449
See application file for complete search history.

(56) References Cited

U.S. PATENT DOCUMENTS

| | | | | |
|---|---|---|---|---|
| 4,110,673 | A * | 8/1978 | Nagy et al. | 318/466 |
| 4,733,617 | A * | 3/1988 | Boeniger | 105/29.2 |
| 6,199,867 | B1 * | 3/2001 | Mahoney et al. | 277/410 |

FOREIGN PATENT DOCUMENTS

| | | | |
|---|---|---|---|
| DE | 102008061852 | A1 | 6/2010 |
| EP | 0118923 | A2 | 9/1984 |
| EP | 1386818 | A1 | 2/2004 |
| EP | 1386818 | B1 | 4/2005 |
| EP | 1792801 | A2 | 6/2007 |

* cited by examiner

*Primary Examiner* — Zachary Kuhfuss
(74) *Attorney, Agent, or Firm* — The Webb Law Firm

(57) ABSTRACT

The invention relates to a retractable step arrangement for a rail vehicle with a first housing that can be mounted on a body of the rail vehicle and features a first housing opening, with a step that is movably supported in the first housing in an initial position and can be displaced between the initial position and a final position, in which the step at least sectionally protrudes from the first housing, through the first housing opening, and with a drive unit for the step that features a motor and at least one movable connecting means that transmits a motion generated by the motor to the step. The retractable step arrangement provides a separate second housing, in which the drive unit is arranged, wherein the interior of the first housing is spatially separated from the interior of the second housing.

19 Claims, 5 Drawing Sheets

RETRACTABLE STEP ARRANGEMENT FOR A RAIL VEHICLE

Figure 1:
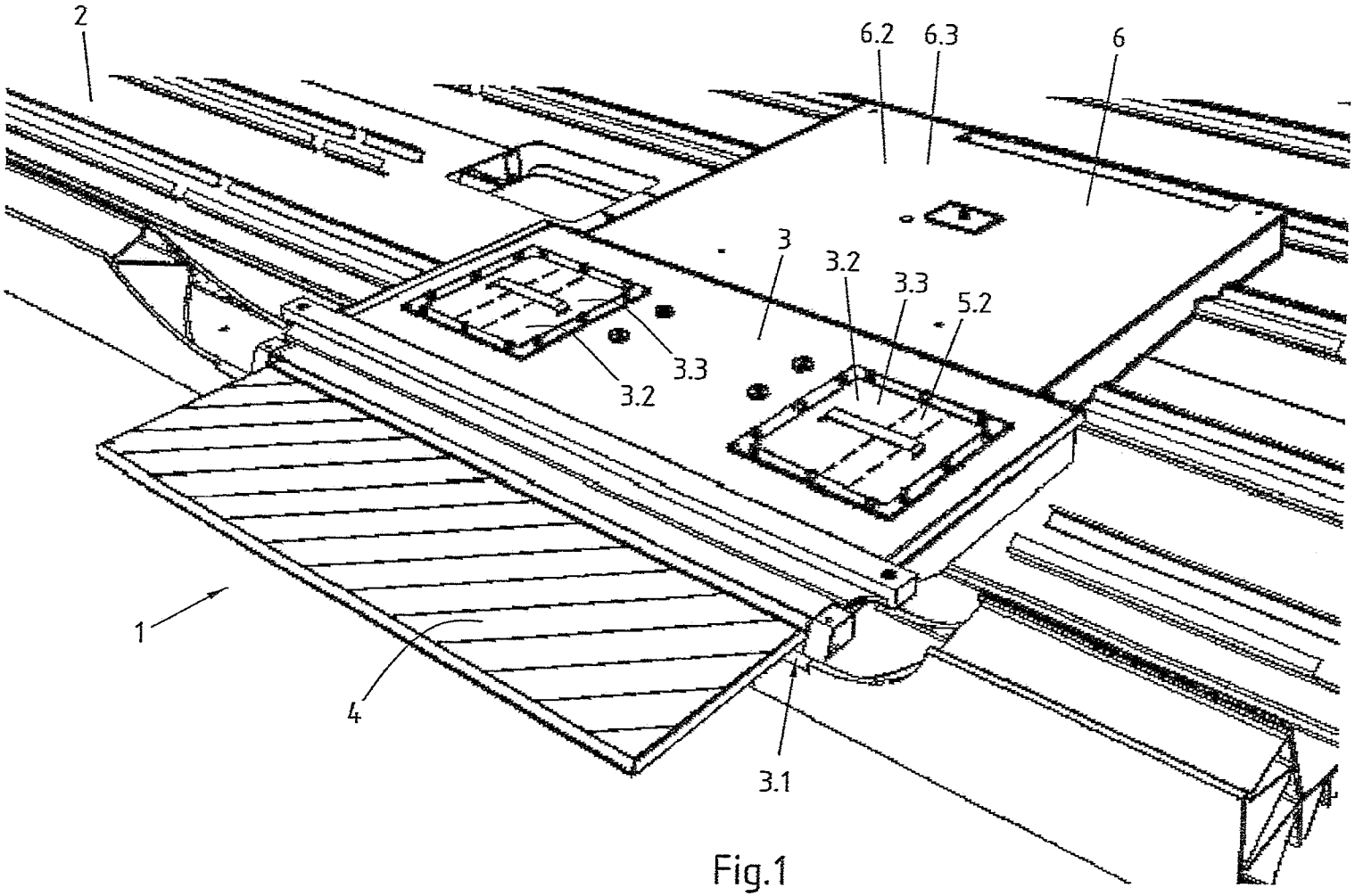

The invention relates to a retractable step arrangement for a rail vehicle with a first housing that can be mounted on a coach body of the rail vehicle (rail vehicle body) and features a first housing opening, with a step that is movably supported in the first housing in an initial position and can be displaced between the initial position and a final position, in which the step at least sectionally protrudes from the first housing, through the first housing opening, and with a drive unit for the step that features a motor and at least one movable connecting means that transmits a motion generated by the motor to the step. The invention furthermore relates to a rail vehicle with such a retractable step arrangement.

Retractable step arrangements, in which a step can be extended from a box that is referred to as housing below, are used in rail vehicles for ensuring the service of low platform heights on the one hand and for minimizing the gap between the coach body of the rail vehicle and the platform on the other hand. However, sufficient space for the constructive integration of a retractable step arrangement is frequently not available within the rail vehicle body such that the box-like housing with the movable step and all its guide and drive elements needs to be mounted underneath the rail vehicle body in such instances. It is also known to mount the step in a receptacle in the superstructure of the rail vehicle body.

In certain instances, however, each of the two mounting alternatives, i.e., the mounting of the retractable step box underneath the rail vehicle body, as well as its mounting in a receptacle in the superstructure, could lead to undesirable disadvantages for constructional reasons. For example, it is particularly disadvantageous to mount the retractable step underneath the rail vehicle body and therefore inevitably on the exterior thereof if the rail vehicle operates in regions, in which temperatures of −40° C. or less occur such as, for example, in Scandinavia during the winter months. At such temperatures, the drive elements of the retractable step arrangement can become sluggish and frequently even freeze in place. Drifting snow can penetrate the housing that encloses the retractable step and its drive and control elements despite all seals or the step being retracted from the platform transports adhering snow and melt water into the housing such that drive and control elements are blocked or damaged. In order to ensure an improved suitability for use during the winter months, it is known, for example, from EP 1 386 818 A1 to provide a separate dry compartment for accommodating the motor and the control within the box of a retractable step arrangement for a rail vehicle. DE 10 2008 061 852 A1 also describes measures for improving the winter suitability of a retractable step arrangement, in which the step and its drive and control elements are accommodated in a box-like housing.

On the other hand, the arrangement of the retractable step arrangement in a receptacle in the superstructure can lead to undesirable weakening of the superstructure because the usually continuous longitudinal beam of the rail vehicle body needs to be interrupted and diverted in the door region. EP 1 792 801 A2 pertains to a retractable step arrangement, in which the step carries out a parabolic motion from the initial position into the final position such that undesirable weakening of the superstructure can be avoided because the housing for the step does not necessarily have to be arranged in the plane, in which the step is situated in its initial position in order to bridge the gap between the rail vehicle body and the platform.

It therefore is an objective of the present invention to provide a retractable step arrangement for a rail vehicle that occupies the least structural space possible and simultaneously has a good suitability for use during winter months.

The above-defined objective is attained, according to a first aspect of the present invention by a retractable step arrangement for a rail vehicle with a first housing that can be mounted on a coach body of the rail vehicle and features a first housing opening, with a step that is movably supported in the first housing in an initial position and can be displaced through the first housing opening, between the initial position and a final position, in which the step at least sectionally protrudes from the first housing, and with a drive unit for the step that features a motor and at least one movable connecting means that transmits a motion generated by the motor to the step such that the step can be moved either in the direction of the initial position or in the direction of the final position, wherein a separate second housing is provided, in which the drive unit is arranged and, in particular, mounted, wherein the interior of the first housing—i.e., the space that is enclosed by the first housing and also referred to as first housing atmosphere below—is spatially and/or hermetically separated from the interior of the second housing—i.e., the space that is enclosed by the second housing and also referred to as second housing atmosphere below. In the context of the present invention, hermetic essentially means air-tight such that, if at all, only impeded air exchange or pressure compensation between the first housing and the second housing takes place.

According to the invention, a separate second housing is provided for accommodating the drive unit and the first and the second housing are spatially separated from one another such that the drive unit comprising the motor with gear components and, if applicable, also a motor control can be spatially separated from the step and the extension mechanism, i.e., the guide. In this way, the drive unit can be positioned independently of the step. The space between the drive unit and the step is bridged by the connecting means that consist, for example, of driving rods. In this way, the entire retractable step arrangement can be realized very flat and positioned in a relatively flat region between the superstructure and the floor of the rail vehicle body because it only occupies a correspondingly small structural space. Consequently, the limited structural space in the bottom region of the outer doors is optimally utilized and the continuity and the stability of the longitudinal beams of the rail vehicle body do not have to be compromised.

A hermetic separation, i.e., an atmospheric separation, provides the advantage that no external air from outside the rail vehicle can be admitted into the interior of the rail vehicle body and, in particular, to the temperature-sensitive components of the drive and control unit of the retractable step through the inevitably existing slot, i.e., the aforementioned first housing opening in the first housing for extending the step. This also ensures the pressure tightness of the interior passenger compartment as it is particularly important in high-speed vehicles. In addition, the components of the drive unit are protected from external influences such as rain water, snow and ice, dirt, significant temperature fluctuations or aerodynamic stresses during the operation. In other words, optimal winter suitability is ensured. If suitable inspection openings are provided in the floor of the rail vehicle body, it is also possible to install and maintain the step and the drive unit in a particularly simple fashion because the inventive design readily makes it possible to vertically arrange the step, as well as the drive unit, directly underneath the floor of the rail vehicle body.

According to one embodiment of the inventive retractable step arrangement, the interior of the first housing is only connected to the external atmosphere outside the rail vehicle. The pressure and, if applicable, the temperature in the first housing therefore are identical to the pressure and the temperature outside the rail vehicle. As mentioned above, however, the atmosphere in the second housing and, in particular, the atmosphere in the interior of the entire rail vehicle body are sealed relative to the first housing atmosphere and therefore the external atmosphere outside the rail vehicle. With the exception of the slot-shaped first housing opening, through which the step can be extended and retracted, the first housing therefore is hermetically sealed.

The interior of the second housing accordingly can only be connected to the internal atmosphere within the rail vehicle body such that the pressure and, if applicable, the temperature in the second housing are identical to the pressure and the temperature in the rail vehicle body. However, it would alternatively also be conceivable that the interior of the second housing has its own atmosphere that is sealed relative to the internal atmosphere within the rail vehicle body. In other words, it is imperative to hermetically separate the second housing from the interior of the first housing although the second housing is not inevitably sealed hermetically.

According to another embodiment of the inventive retractable step arrangement, the first housing and/or the second housing feature/s at least one inspection opening. Such an inspection opening makes it possible to easily install and, if applicable, maintain and/or exchange components of the retractable step arrangement that are accessible through this opening.

In order to simplify the maintenance and installation, the respective inspection opening and, in particular, all inspection openings may lead into the interior of the rail vehicle body. In this case, at least the inspection opening of the first housing can be hermetically sealed with an inspection cover. If the second housing also features an inspection opening that leads into the interior of the rail vehicle body, it is possible, although not imperative, to realize this opening such that it can be hermetically sealed as well.

According to yet another embodiment of the inventive retractable step arrangement, the drive unit consists of a preassembled structural unit, i.e., a so-called installation unit, such that the final assembly is significantly simplified. For example, the drive unit can be preassembled in a facility specializing in the assembly of drive units and then transported to the final assembly site, at which the drive unit can be installed at the intended location in its entirety, i.e., as one individual component. In this case, the structural unit is separably mounted in the second housing, particularly in its entirety. In this context, separably means that the structural unit can be readily removed from the housing. However, it would basically also be conceivable that the drive unit forms a preassembled structural unit together with the second housing. In this case, the second housing with the components of the drive unit installed therein can be mounted on the rail vehicle body in a particularly simple fashion in one step. Since all components that form the drive unit are already preassembled in the second housing, these components are also particularly well protected during installation and maintenance procedures, i.e., when the drive unit is moved during its installation or removal.

However, the components that form the drive unit may also be connected to one another by means of a common carrier plate such that the carrier plate and the components of the drive unit form the structural unit. In this case, the carrier plate preferably serves for mounting the structural unit in the second housing. As already mentioned above, the drive unit and therefore, if applicable, the preassembled structural unit comprises at least the motor and the gear components, as well as a motor control, if applicable. The connecting means for transmitting the motion generated by the motor to the step may also form part of the structural unit.

It would, in principle, also be conceivable that the step forms part of a structural unit, for example, together with the extension mechanism. Such a structural unit can also be separably mounted in the first housing in its entirety. According to yet another embodiment of the inventive retractable step arrangement, the at least one connecting means is realized in the form of a driving rod that connects the drive unit, particularly the motor, to the step. It would, in principle, also be possible to use two driving rods that, in particular, extend parallel to one another for connecting the drive unit and the step. Such driving rods are particularly well suited for bridging the distance between the drive unit, particularly motor with its gear components, and the step in a stable fashion. It is also particularly simple to configure the driving rods such that they extend through correspondingly sealed leadthroughs that are referred to as so-called connection openings below. In this case, it would be conceivable that the at least one connecting means extends through a connection opening provided in the first housing and in the second housing, particularly if the connecting means consists of a driving rod.

The connection opening in the first housing and/or in the second housing for leading through the connecting means, particularly the driving rod, is preferably sealed in order to ensure the hermetic separation between the interior of the first housing and the interior of the second housing. If two connecting means or two driving rods are provided, each of these connecting means may extend through a separate connection opening in the first housing and in the second housing, wherein a corresponding seal also needs to be provided for each connecting means or each driving rod in this case.

According to a second aspect, the objective of the invention is furthermore attained with a rail vehicle that features a retractable step arrangement of the above-described type. According to one embodiment of the inventive rail vehicle, the first housing and/or the second housing are/is rigidly connected to the rail vehicle body, particularly welded or screwed thereto. At least the first housing preferably is inseparably connected to the rail vehicle body, particularly welded thereto. According to one embodiment, the second housing may be realized such that it can be detached from the rail vehicle body in its entirety as already described above, wherein the second housing is in this case preferably connected to the rail vehicle body by means of a screw connection. However, the second housing may, in principle, also be welded to the rail vehicle body.

According to another embodiment of the inventive rail vehicle, the inspection opening of the first housing leads into the interior of the rail vehicle body and is hermetically sealed with a first inspection cover. The inspection opening of the second housing may alternatively or additionally also lead into the interior of the rail vehicle body and be sealed with a second inspection cover. As described above, however, it is not absolutely imperative to hermetically seal the second housing.

According to another embodiment of the inventive rail vehicle, it is furthermore proposed that the first housing is arranged underneath the floor—i.e., vertically underneath the floor—of the rail vehicle body, wherein at least one inspection opening is preferably arranged in the floor vertically above the first housing, in particular vertically above the at least one inspection opening of the first housing. In this way, the installation and maintenance of the step can be carried out in a particularly simple fashion. According to yet another embodiment of the inventive rail vehicle, the second housing is arranged underneath the floor—i.e., vertically underneath the floor—of the rail vehicle. In this case, at least one inspection opening may also be provided in the floor vertically above the second housing. This inspection opening is configured, in particular, in such a way or has such dimensions and/or such a shape that the second housing or the structural unit forming the drive unit can be guided through the inspection opening.

Figure 2B:
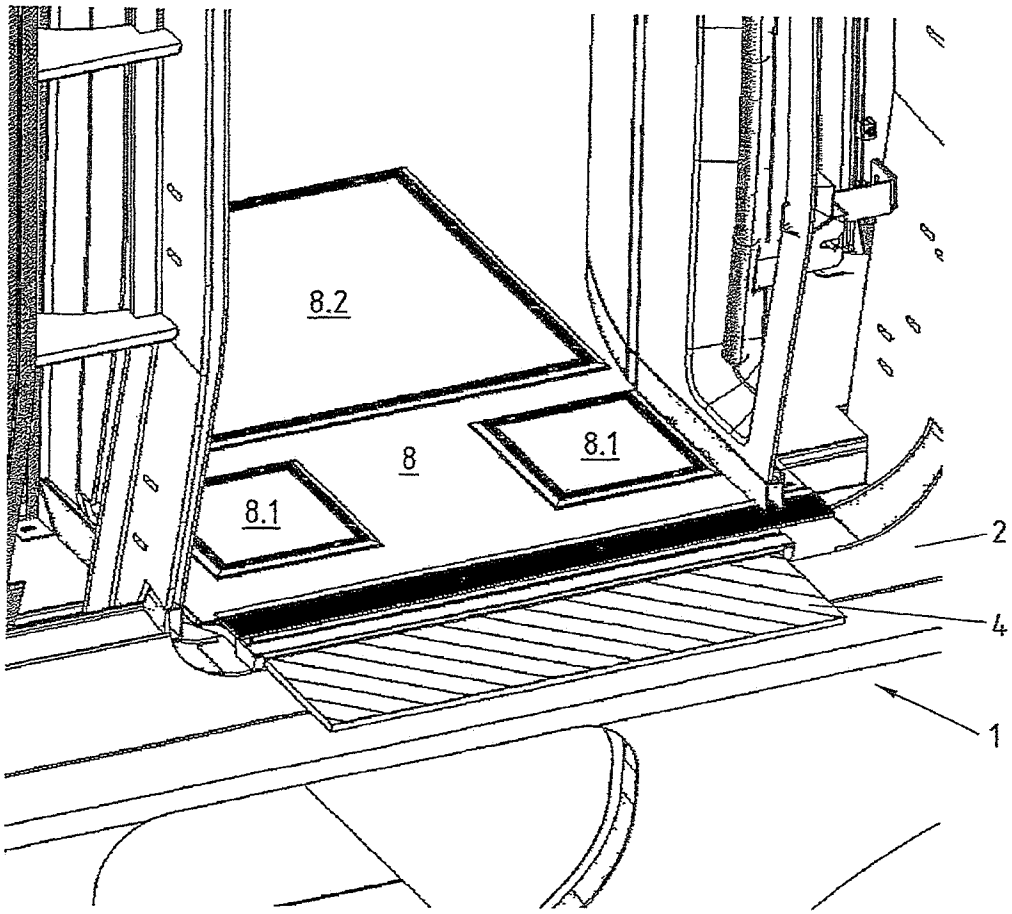
Figure 2A:
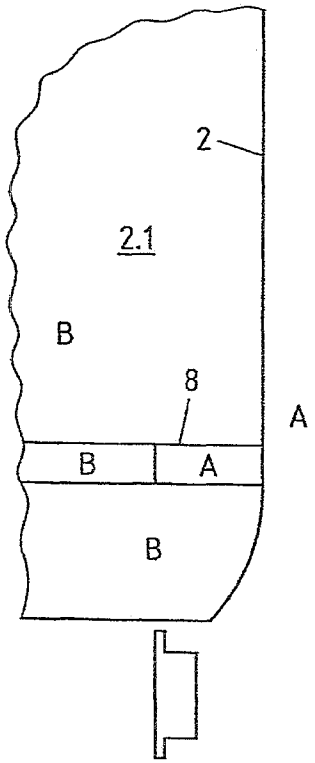
Figure 3B:
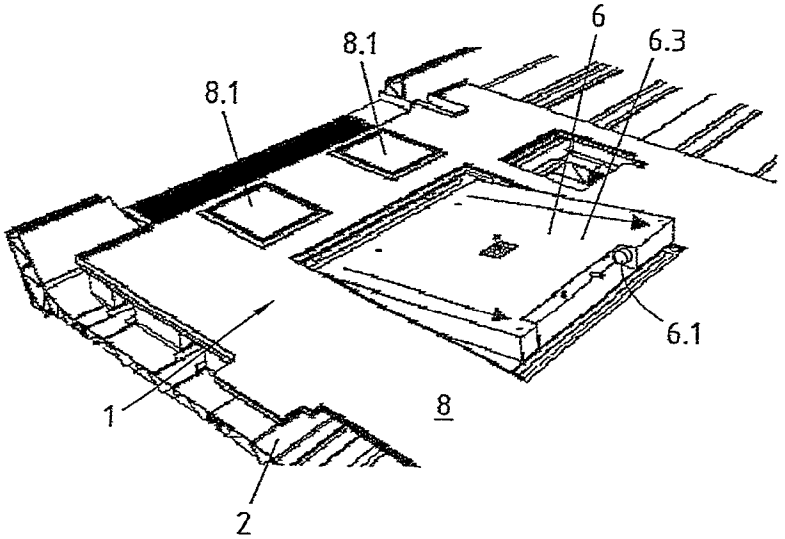
Figure 3A:
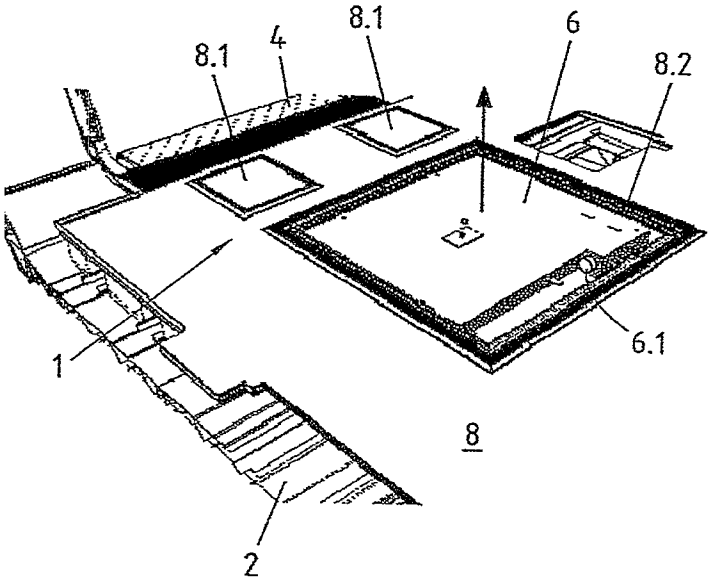
Figure 4B:
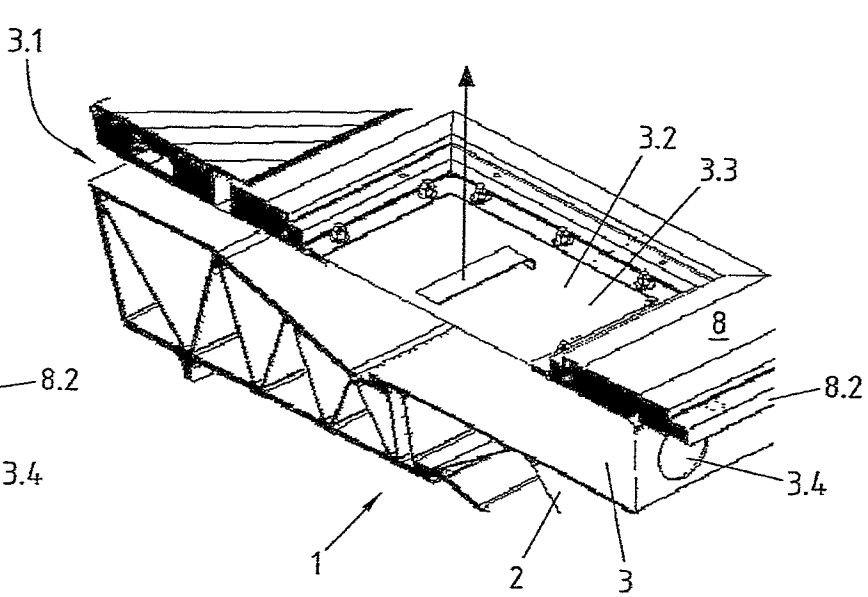
Figure 4A:
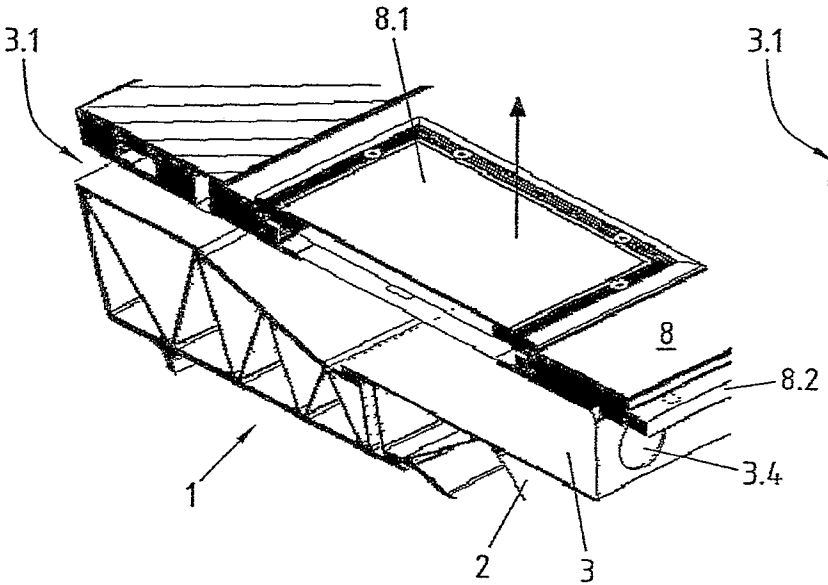
Figure 5:
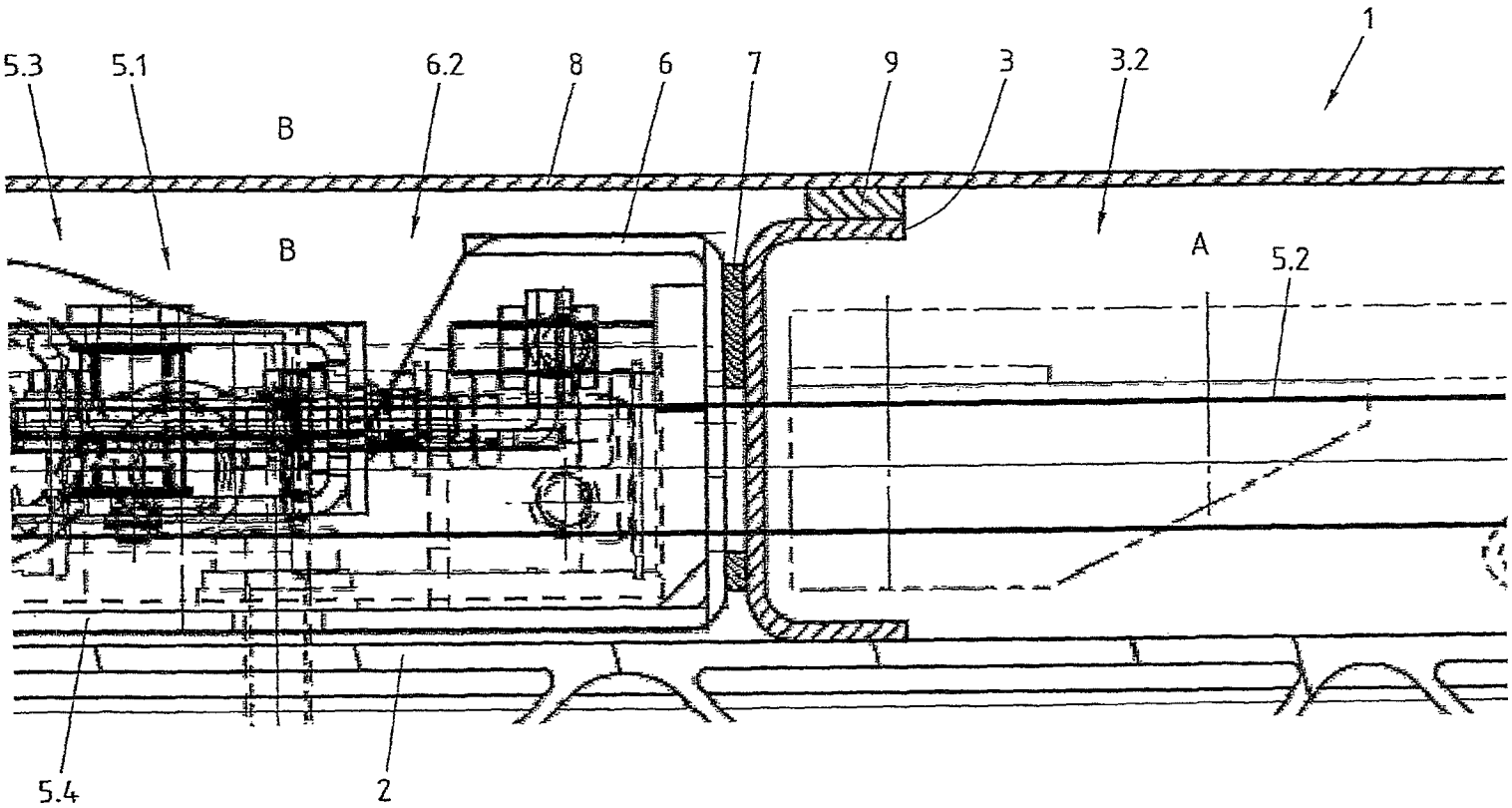

The inventive retractable step arrangement and the inventive rail vehicle can be designed and enhanced in numerous ways. In this respect, we refer to the claims that follow to claim 1 on the one hand and to the description of exemplary embodiments that are illustrated in the drawings on the other hand. In these drawings:

FIG. 1 shows a perspective view of a retractable step arrangement mounted on the shell structure of a rail vehicle body, FIG. 2*a*) shows a schematic view of a rail vehicle, FIG. 2*b*) shows a perspective view of a rail vehicle body with installed retractable step arrangement, FIGS. 3*a*) and *b*) show a schematic representation of a maintenance procedure carried out on the drive unit of the retractable step arrangement according to FIG. 1, FIGS. 4*a*) and *b*) show a schematic representation of a maintenance procedure carried out on the step of the retractable step arrangement according to FIG. 1, and FIG. 5 shows a sectional representation of part of the retractable step arrangement according to FIG. 1.

FIG. 1 shows a retractable step arrangement 1 for a rail vehicle, of which only part of the superstructure (shell structure) 2.2 of the rail vehicle body 2 is illustrated in this figure in order to provide a better overview. The retractable step arrangement 1 features a first housing 3 that is mounted on the body 2 of the rail vehicle and features a first housing opening 3.1 in the form of a slot, through which a step 4 can be extended and retracted. In an initial position, the step 4 is movably supported in the first housing 3 and can be displaced between the initial position and a final position, in which the step at least sectionally protrudes from the first housing, through the first housing opening 3.1. In FIG. 1, the step 4 is illustrated in its initial position. The retractable step arrangement 1 furthermore features a drive unit 5 for the step 4 that comprises a motor 5.1, connecting means 5.2 and other components 5.3 such as a motor control and gear components. In FIG. 1, the drive unit 5 is arranged in a separate second housing 6, wherein only the connecting means 5.2 are visible through transparent inspection covers 3.3. In this case, the connecting means 5.2 consist of two parallel driving rods that transmit a motion generated by the motor 5.1 of the drive unit 5 to the step 4 in order to displace the step between the initial position and the final position.

According to an essential characteristic of the present invention, the interior of the first housing 3 is separated from the interior of the second housing 6, in which the drive unit 5 is mounted, spatially and hermetically, i.e., in an air-tight fashion. In this case, the interior of the first housing 3 is only connected to the external atmosphere A outside the rail vehicle by means of the slot-shaped first housing opening 3.1 such that the pressure and essentially also the temperature in the first housing 3 are identical to the pressure and the temperature outside the rail vehicle. The interior of the second housing 6 is not connected to the atmosphere A in the first housing 3, but rather only to the internal atmosphere B within the rail vehicle body 2. Consequently, the pressure and essentially also the temperature in the interior of the second housing 6 are identical to the pressure and the temperature in the interior of the rail vehicle body 2, particularly in the interior passenger compartment 2.1.

The atmospheric circumstances are schematically illustrated in FIG. 2*a*). FIG. 2*a*) schematically shows the areas with the external atmosphere A and the hermetically separated areas with the internal atmosphere B for the design illustrated in FIG. 2*b*), namely while the outer door is closed.

FIG. 2*b*) shows the same retractable step arrangement 1 as FIG. 1, but the floor 8 of the rail vehicle body 2 is also illustrated in this figure. FIGS. 1 and 2*b*) jointly elucidate that a structural space with only a very small height is available for both housings 3 and 6, wherein the bottom of this structural space is defined by the shell structure 2.2 and its top is defined by the floor 8 of the rail vehicle body 2. Accordingly, the first housing 3, as well as the second housing 6, is realized in a plate-shaped fashion, i.e., it has a thickness (height) that is many times smaller than its length and width. With respect to the first housing 3 of the inventive retractable step arrangement 1, for example, the ratio of the housing width that essentially corresponds to the width of the door opening to the housing thickness (housing height) is at least 5:1, preferably at least 7:1, particularly at least 8:1. In the instance illustrated in FIG. 1, the ratio is 10:1, i.e., the width of the housing 3 that essentially corresponds to the width of the door opening above this housing is 10-times greater than the housing thickness. The same ratio may also apply to the second housing 6. This elucidates that the housings 3 and 6 have an extremely flat construction and therefore can be easily inserted into the already existing and otherwise unused space between the floor 8 and the rail vehicle body structure 2.2 underneath this floor.

FIG. 2*b*) furthermore shows two inspection openings 8.1 in the floor 8 that are closed in this figure, wherein said inspection openings are arranged above the first housing 3 and, in particular, above the inspection openings 3.2 or the transparent inspection covers 3.3, respectively. An inspection opening 8.2 that is closed in the figure is arranged farther toward the vehicle center above the second housing 6, wherein the inspection opening 6.2 or the inspection cover 6.3 of the second housing 6 is also accessible through the inspection opening 8.2.

The following portion of the description elucidates how a maintenance procedure can be carried out through the inspection openings 8.1 and 8.2 with reference to FIGS. 3*a*), 3*b*), 4*a*) and 4*b*).

Finally, FIGS. 3*a*) and *b*) initially show maintenance of the drive unit 5. For this purpose, the inspection opening 8.2 in the floor 8 is initially opened as symbolically illustrated with an arrow that points vertically upward in FIG. 3*a*). After the plug connector 6.1 for producing the connection with the on-board electrical system has been separated, the complete second housing 6 can subsequently be lifted out through the inspection opening 8.2 in its entirety as symbolically illustrated in FIG. 3*b*). In this case, the connecting means or driving rods 5.2 that connect the drive unit 5 to the step 4 may remain underneath the floor 8 or alternatively be lifted out through the inspection opening 8.2 together with the housing 6.

After the inspection opening 8.2 has been opened, the housing 6 may alternatively also remain underneath the floor 8 and only the inspection opening 6.2 of the housing 6 may be opened.

FIGS. 4*a*) and *b*) show an option for maintenance of the step 4. In this case, the inspection opening 8.1 in the floor 8 also is initially opened as symbolically illustrated with an arrow that points vertically upward in FIG. 4*a*). It would be possible, but is not absolutely imperative, to realize the inspection opening 8.1 such that it can be hermetically sealed. The inspection cover 3.3 of the inspection opening 3.2 of the housing 3 is situated underneath the aforementioned inspection opening. The inspection opening 3.2 is hermetically sealed. The housing interior and the step 4 can be accessed by removing the inspection cover 3.3 as symbolically illustrated with an arrow that points vertically upward in FIG. 4*b*).

FIGS. 4*a*) and *b*) furthermore show a connection opening 3.4 for leading through one of the rod-shaped connecting means 5.2 that connect the drive unit 5 to the step 4. The connection opening 3.4 can be sealed with a peripheral seal that is in sealing contact with the edge of the opening on one side and with the driving rod 5.2 on the other side.

Other seals 7 and 9 may be alternatively or additionally provided in order to separate the external atmosphere A from the internal atmosphere B and, in particular, to hermetically separate the interior of the first housing 3 from the interior of the second housing 6. To this end, a seal 7 that may be arranged, for example, between the housing 3 and the housing 6 such that no air from the housing 3 can be admitted into the rail vehicle body 2 through the intermediate space between the housing 3 and the housing 6. Another seal 9 serves as a seal between the first housing 3 and the floor 8 of the rail vehicle body 2 extending above the first housing and prevents external air from being admitted into the rail vehicle body 2.

FIG. 5 schematically shows the components that form the drive unit 5 in the exemplary embodiment illustrated in the figures such as, among other things, a motor 5.1 with gear components, the driving rods that form the connecting means 5.2, as well as other components 5.3, e.g., a motor control, mounting means, bearing means, etc. All components are mounted on a carrier plate 5.4 that forms the bottom of the housing 6 in this case, but may basically also consist of a separate component that is connected to the housing 6, and combined into a preassembled structural unit or so-called installation unit.

The invention claimed is:

1. A retractable step arrangement for a rail vehicle
with a first housing that is mountable on a coach body of the rail vehicle and features a first housing opening,
with a step that is movably supported in the first housing in an initial position and is displaceable through the first housing opening between the initial position and a final position, in which the step at least sectionally protrudes from the first housing, and
with a drive unit for the step that features a motor and at least one movable connecting means that transmits a motion generated by the motor to the step,
wherein the drive unit comprises at least the motor with gear components, wherein a separate second housing is provided, in which the drive unit is arranged, wherein the interior of the first housing is spatially separated from the interior of the second housing, wherein the at least one connecting means consists of a driving rod that connects the drive unit to the step, and wherein the at least one connecting means extends through respective connection openings provided in the first housing and the second housing in a hermetically sealed fashion.

2. The retractable step arrangement according to claim 1, wherein the interior of the first housing is hermetically separated from the interior of the second housing.

3. The retractable step arrangement according to claim 2, wherein the interior of the first housing is only connected to the external atmosphere outside the rail vehicle and/or the interior of the second housing is only connected to the internal atmosphere within the coach body.

4. The retractable step arrangement according to claim 1, wherein at least one of the first housing and the second housing features at least one inspection opening, wherein the respective inspection opening is hermetically sealed with an inspection cover.

5. The retractable step arrangement according to claim 4, wherein the inspection opening leads into the interior of the coach body.

6. The retractable step arrangement according to claim 1, wherein the drive unit consists of a preassembled structural unit that is separably mounted in the second housing.

7. The retractable step arrangement according to claim 6, wherein the components forming the drive unit are connected to one another by means of a common carrier plate.

8. The retractable step arrangement according to claim 1, wherein the at least one connecting means extends through a connection opening in a hermetically sealed fashion.

9. A rail vehicle with a retractable step arrangement according to claim 1.

10. The rail vehicle according to claim 9, wherein at least one of the first housing and the second housing is rigidly connected to the coach body.

11. The rail vehicle according to claim 10, wherein at least one of the first housing and the second housing is welded or screwed to the coach body.

12. The rail vehicle according to claim 9, wherein an inspection opening of the first housing leads into the interior of the coach body and is hermetically sealed with a first inspection cover and/or an inspection opening of the second housing leads into the interior of the rail vehicle body and is sealed with a second inspection cover.

13. The rail vehicle according to claim 9, wherein the first housing is arranged underneath the floor of the coach body.

14. The rail vehicle according to claim 13, wherein at least one inspection opening is arranged in the floor vertically above the first housing.

15. The rail vehicle according to claim 14, wherein the inspection opening arranged in the floor vertically above the first housing is arranged vertically above the at least one inspection opening of the first housing.

16. The rail vehicle according to claim 9, wherein the second housing is arranged underneath the floor of the coach body.

17. The rail vehicle according to claim 16, wherein at least one inspection opening is provided in the floor vertically above the second housing.

18. The rail vehicle according to claim 17, wherein the inspection opening arranged in the floor vertically above the second housing is configured in such a way that one of the second housing and the structural unit forming the drive unit is guided through the inspection opening.

19. A retractable step arrangement for a rail vehicle
with a first housing that is mountable on a coach body of the rail vehicle and features a first housing opening,
with a step that is movably supported in the first housing in an initial position and is displaceable through the first housing opening between the initial position and a final position, in which the step at least sectionally protrudes from the first housing, and
with a drive unit for the step that features a motor and at least one movable connecting means that transmits a motion generated by the motor to the step,
wherein a separate second housing is provided, in which the drive unit is arranged, wherein the interior of the first housing is spatially separated from the interior of the second housing, and wherein the at least one connecting means extends through respective connection openings provided in the first housing and the second housing in a hermetically sealed fashion.

* * * * *